US010815812B2

(12) United States Patent
Barak et al.

(10) Patent No.: US 10,815,812 B2
(45) Date of Patent: Oct. 27, 2020

(54) GEOMETRY OPTIMIZED BLADE OUTER AIR SEAL FOR THERMAL LOADS

(71) Applicant: United Technologies Corporation, Farmington, CT (US)

(72) Inventors: Daniel Barak, Jupiter, FL (US); Joseph F. Englehart, Gastonia, NC (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 206 days.

(21) Appl. No.: 15/920,819

(22) Filed: Mar. 14, 2018

(65) Prior Publication Data

US 2019/0032505 A1 Jan. 31, 2019

Related U.S. Application Data

(60) Provisional application No. 62/505,385, filed on May 12, 2017.

(51) Int. Cl.

| | |
|---|---|
| ***F01D 11/16*** | (2006.01) |
| ***F01D 25/24*** | (2006.01) |
| ***F01D 11/08*** | (2006.01) |

(52) U.S. Cl.

CPC ..... *F01D 11/16* (2013.01); *F01D 11/08* (2013.01); *F01D 25/246* (2013.01); *F05D 2220/32* (2013.01); *F05D 2230/60* (2013.01); *F05D 2240/11* (2013.01); *F05D 2240/307* (2013.01); *F05D 2240/55* (2013.01); *F05D 2250/294* (2013.01)

(58) Field of Classification Search

CPC ..... F01D 11/08; F01D 11/10; F01D 11/14; F01D 11/16; F01D 11/18; F01D 11/24; F01D 25/246

See application file for complete search history.

(56) References Cited

U.S. PATENT DOCUMENTS

| | | | | |
|---|---|---|---|---|
| 7,553,128 | B2 * | 6/2009 | Abdel-Messeh | F01D 5/187 415/116 |
| 7,665,962 | B1 * | 2/2010 | Liang | F01D 11/24 415/173.1 |
| 8,439,636 | B1 * | 5/2013 | Liang | F01D 25/246 415/173.1 |

(Continued)

FOREIGN PATENT DOCUMENTS

| | | | |
|---|---|---|---|
| FR | 2955898 | A1 | 8/2011 |
| WO | 2011073570 | A1 | 6/2011 |

(Continued)

OTHER PUBLICATIONS

Extended European Search Report for Application No. 18176911-1006; Report dated Jun. 25, 2018; Report Received Date: Sep. 18, 2018; 8 pages.

*Primary Examiner* — Ninh H. Nguyen
*Assistant Examiner* — Aye S Htay
(74) *Attorney, Agent, or Firm* — Cantor Colburn LLP

(57) ABSTRACT

A blade outer air seal (BOAS) is provided. The BOAS comprising: a seal body having a forward side, an aft side opposite the forward side, a radially inward side, and a radially outward side opposite the radially inward side; and a relief gap within the seal body to allow a portion of the radially inward side to expand into the relief gap when the seal body is heated.

10 Claims, 4 Drawing Sheets

(56) References Cited

U.S. PATENT DOCUMENTS

| | | | | |
|---|---|---|---|---|
| 9,080,458 | B2 * | 7/2015 | Romanov | F01D 11/08 |
| 9,169,739 | B2 * | 10/2015 | Mironets | F01D 11/12 |
| 9,238,970 | B2 | 1/2016 | Thibodeau | |

FOREIGN PATENT DOCUMENTS

| | | | |
|---|---|---|---|
| WO | 2014186099 | A1 | 11/2014 |
| WO | 2015109292 | A1 | 7/2015 |

* cited by examiner

GEOMETRY OPTIMIZED BLADE OUTER AIR SEAL FOR THERMAL LOADS

CROSS-REFERENCE TO RELATED APPLICATIONS

This application claims the benefit of U.S. Provisional Application No. 62/505,385 filed May 12, 2017, which is incorporated herein by reference in its entirety.

BACKGROUND

The subject matter disclosed herein generally relates to gas turbine engines and, more particularly, to blade outer air seals for gas turbine engines.

Gas turbine engines are designed to have minimal clearances between outer edges of turbine blades (blade tips) and inner surfaces of rotor case shrouds, i.e., blade outer air seals. With increased clearance comes more aerodynamic loss (inefficiency) commonly referred to as "tip leakage." The clearances between the blade tips and the inner surfaces of the blade outer air seals are often oversized to avoid undesirable abrasion ("rubbing") between these two components. The oversizing clearance gap is undesirable as it represents a loss in overall gas turbine engine cycle efficiency. This is especially pertinent to typical aero-gas turbine engines which operate in a typical open Brayton cycle and have no additional thermodynamic benefits that may be derived from, for example, recuperation, turbo-compounding, combining with other cycles (Rankine, Otto, Diesel, Miller, etc.), etc. Excessive heating of the blade outer air seal may lead to increase clearances and may also put additional stress on the blade outer air seal.

More emphasis of the main propulsion share of a gas turbine engine is shifted to the bypass air flow compared to the core air flow. Therefore, while the bypass fan increases in diameter, the engine's core is shrinking in diameter. Accordingly, all of the internal rotation components of the engine core are being reduced in size. As a result ever tighter internal clearances are desired to optimize the performance of the core of the gas turbine engine. Accordingly it may be desirable to improve optimization of the clearance.

SUMMARY

According to one embodiment, a blade outer air seal (BOAS) is provided. The BOAS comprising: a seal body having a forward side, an aft side opposite the forward side, a radially inward side, and a radially outward side opposite the radially inward side; and a relief gap within the seal body to allow a portion of the radially inward side to expand into the relief gap when the seal body is heated.

In addition to one or more of the features described above, or as an alternative, further embodiments of the BOAS may include where the relief gap is located on the forward side of the seal body.

In addition to one or more of the features described above, or as an alternative, further embodiments of the BOAS may include where the relief gap initiates on the forward side of the seal body and extends into the seal body a first distance.

In addition to one or more of the features described above, or as an alternative, further embodiments of the BOAS may include where the relief gap is located at a second distance away from the radially inward side.

In addition to one or more of the features described above, or as an alternative, further embodiments of the BOAS may include a peninsula portion interposed between the relief gap and the radially inward side.

In addition to one or more of the features described above, or as an alternative, further embodiments of the BOAS may include where thickness of the peninsula portion decreases towards the forward side.

In addition to one or more of the features described above, or as an alternative, further embodiments of the BOAS may include where radially inward side at the peninsula portion curves towards the relief gap.

In addition to one or more of the features described above, or as an alternative, further embodiments of the BOAS may include where the forward side of the peninsula portion is offset towards the aft side from a remaining portion of the forward side.

According to another embodiment, a blade-tip clearance system for a gas turbine engine, the blade tip clearance system comprising: an engine case; a blade outer air seal (BOAS) connected to the engine case, the BOAS including: a seal body having a forward side, an aft side opposite the forward side, a radially inward side, and a radially outward side opposite the radially inward side; and a relief gap within the seal body to allow a portion of the radially inward side to expand into the relief gap when the seal body is heated.

In addition to one or more of the features described above, or as an alternative, further embodiments of the blade-tip clearance system may include where the relief gap is located on the forward side of the seal body.

In addition to one or more of the features described above, or as an alternative, further embodiments of the blade-tip clearance system may include where the relief gap initiates on the forward side of the seal body and extends into the seal body a first distance.

In addition to one or more of the features described above, or as an alternative, further embodiments of the blade-tip clearance system may include where the relief gap is located at a second distance away from the radially inward side.

In addition to one or more of the features described above, or as an alternative, further embodiments of the blade-tip clearance system may include a peninsula portion interposed between the relief gap and the radially inward side.

In addition to one or more of the features described above, or as an alternative, further embodiments of the blade-tip clearance system may include where thickness of the peninsula portion decreases towards the forward side.

In addition to one or more of the features described above, or as an alternative, further embodiments of the blade-tip clearance system may include where radially inward side at the peninsula portion curves towards the relief gap.

In addition to one or more of the features described above, or as an alternative, further embodiments of the blade-tip clearance system may include where the forward side of the peninsula portion is offset towards the aft side from a remaining portion of the forward side.

In addition to one or more of the features described above, or as an alternative, further embodiments of the blade-tip clearance system may include where the BOAS connected to the engine case through at least one hook on the engine case interlocked with at least one hook on the BOAS.

In addition to one or more of the features described above, or as an alternative, further embodiments of the blade-tip clearance system may include where the BOAS connected to the engine case through a forward hook on the engine case interlocked with a forward hook on the forward side of the BOAS and an aft hook on the engine case interlocked with an aft hook on the aft side of the BOAS.

In addition to one or more of the features described above, or as an alternative, further embodiments of the blade-tip clearance system may include where the BOAS further comprises a cooling fluid compartment within the body, the cooling fluid compartment being fluidly connected to a cooling fluid compartment within the engine case.

According to another embodiment, a method of assembling a blade-tip clearance system for a gas turbine engine is provided. The method comprising: forming a blade outer air seal (BOAS), the BOAS including: a seal body having a forward side, an aft side opposite the forward side, a radially inward side, and a radially outward side opposite the radially inward side; one or more hooks on the radially outward side of the BOAS; and a relief gap within the seal body to allow a portion of the radially inward side to expand into the relief gap when the seal body is heated; obtaining an engine case including one or more hooks on the engine case; and connecting the BOAS to the engine case by interlocking the one or more hooks on the radially outward side of the BOAS with the one or more hooks on the engine case.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

The detailed description explains embodiments of the present disclosure, together with advantages and features, by way of example with reference to the drawings.

DETAILED DESCRIPTION

A detailed description of one or more embodiments of the disclosed apparatus and method are presented herein by way of exemplification and not limitation with reference to the Figures.

Figure 1:
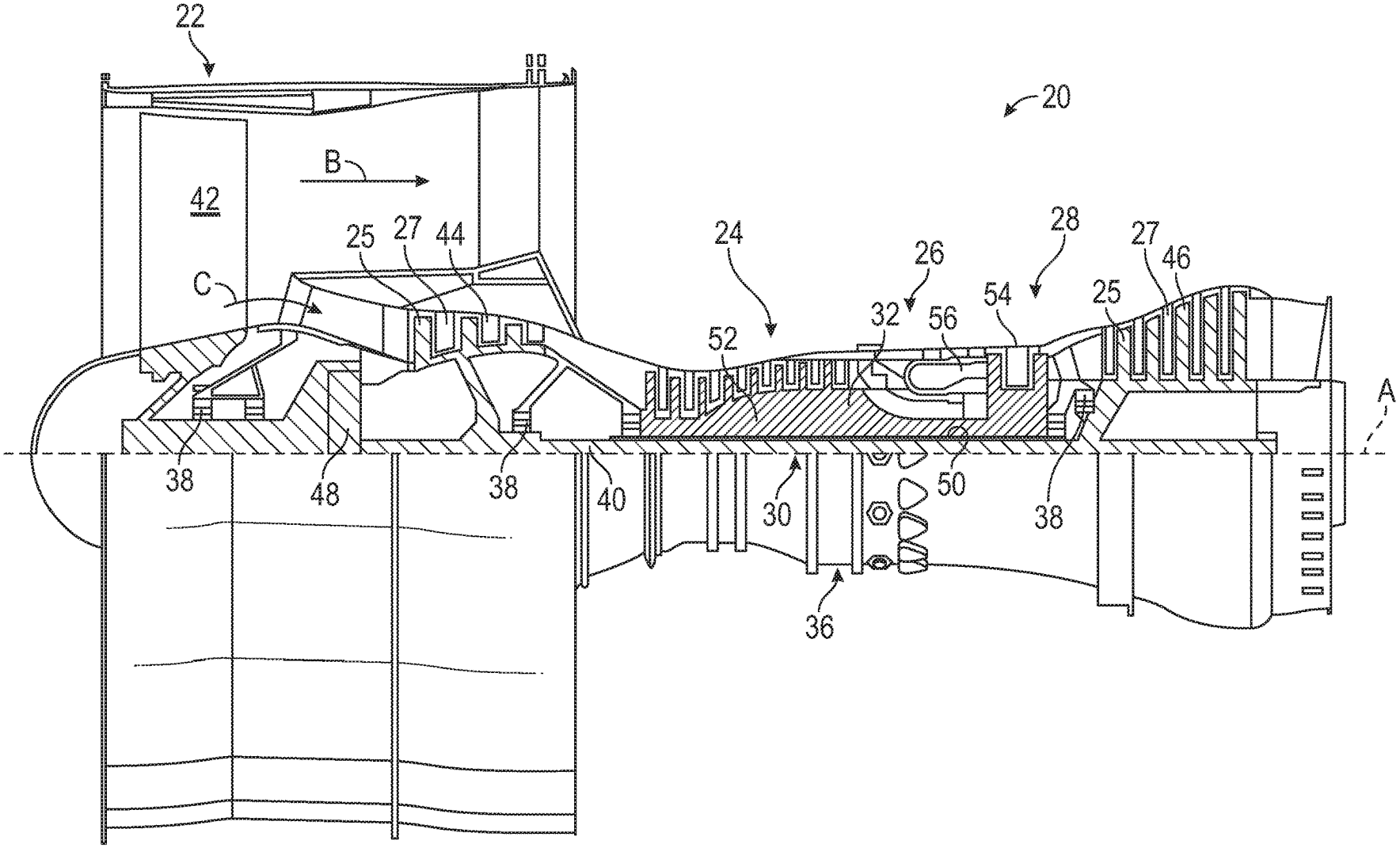
FIG. 1 is a cross-sectional illustration of an aircraft engine, in accordance with an embodiment of the disclosure

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition— typically cruise at about 0.8Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tram ° R)/(518.7° R)]0.5. The "Low corrected fan tip speed" as disclosed herein according to one non-limiting embodiment is less than about 1150 ft/second (350.5 m/sec).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require withstand extreme temperatures. Example of such components include features such as blade outer air seals (BOAS) are discussed below.

Figure 2:
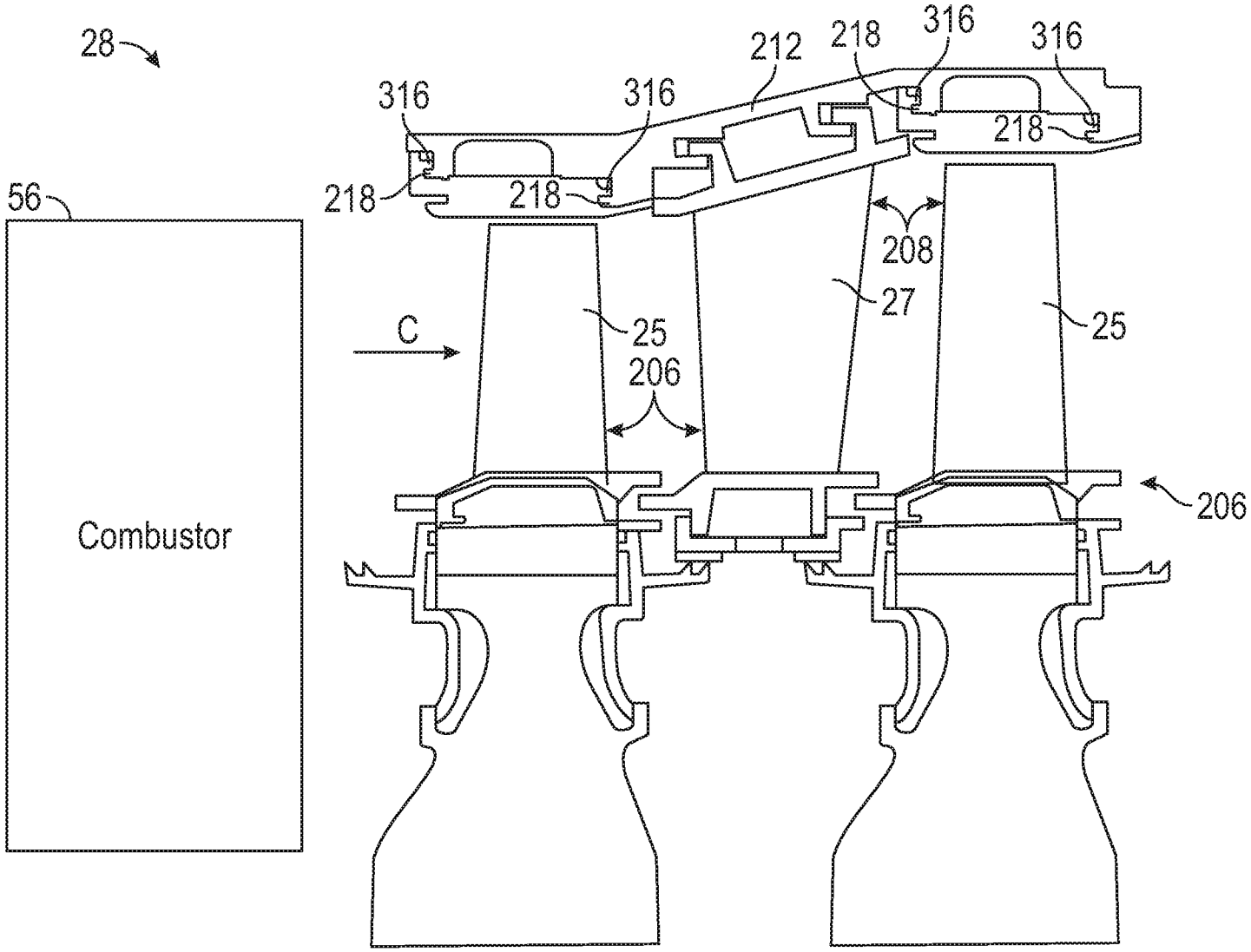
FIG. 2 is a schematic cross-sectional illustration of a section of a gas turbine engine, in accordance with an embodiment of the disclosure.

FIG. 2 is a schematic view of a turbine section 28 that may employ various embodiments disclosed herein. The turbine section 28 is aft of the combustor 56 along core flow path C. For simplicity, a block diagram has been used to illustrate the combustor 56. The turbine section 28 includes a plurality of airfoils, including, for example, one or more blades 25 and vanes 27. The airfoils 25, 27 may be hollow bodies with internal cavities defining a number of channels or cavities, hereinafter airfoil cavities, formed therein and extending from an inner diameter 206 to an outer diameter 208, or vice-versa.

The turbine section 28 is housed within an engine case 212, which may have multiple parts (e.g., turbine case, diffuser case, etc.). In various locations, components, such as seals, may be positioned between airfoils 25, 27 and the case 212. For example, as shown in FIG. 2, blade outer air seals 302 (hereafter "BOAS") are located radially outward from the blades 25. As will be appreciated by those of skill in the art, the BOAS 302 can include BOAS supports that are configured to fixedly connect or attach the BOAS 302 to the case 212 (e.g., the BOAS supports can be located between the BOAS and the case). As shown in FIG. 2, the case 212 includes a plurality of hooks 218 that engage with the hooks 316 to secure the BOAS 302 between the case 212 and a tip of the blade 25.

In traditional gas turbine engine configurations, a first stage BOAS is aft of a combustor and is exposed to high temperatures expelled therefrom. Accordingly, thermal gradients across the BOAS may create stress in the BOAS causing the BOAS to expand at different rates across the BOAS. Additionally, thermal gradients within the BOAS may lead to undesirably large and uneven clearances between the BOAS and the blades which are, in essence, an aerodynamic loss mechanism. It is desirable to avoid such losses.

Figure 3:
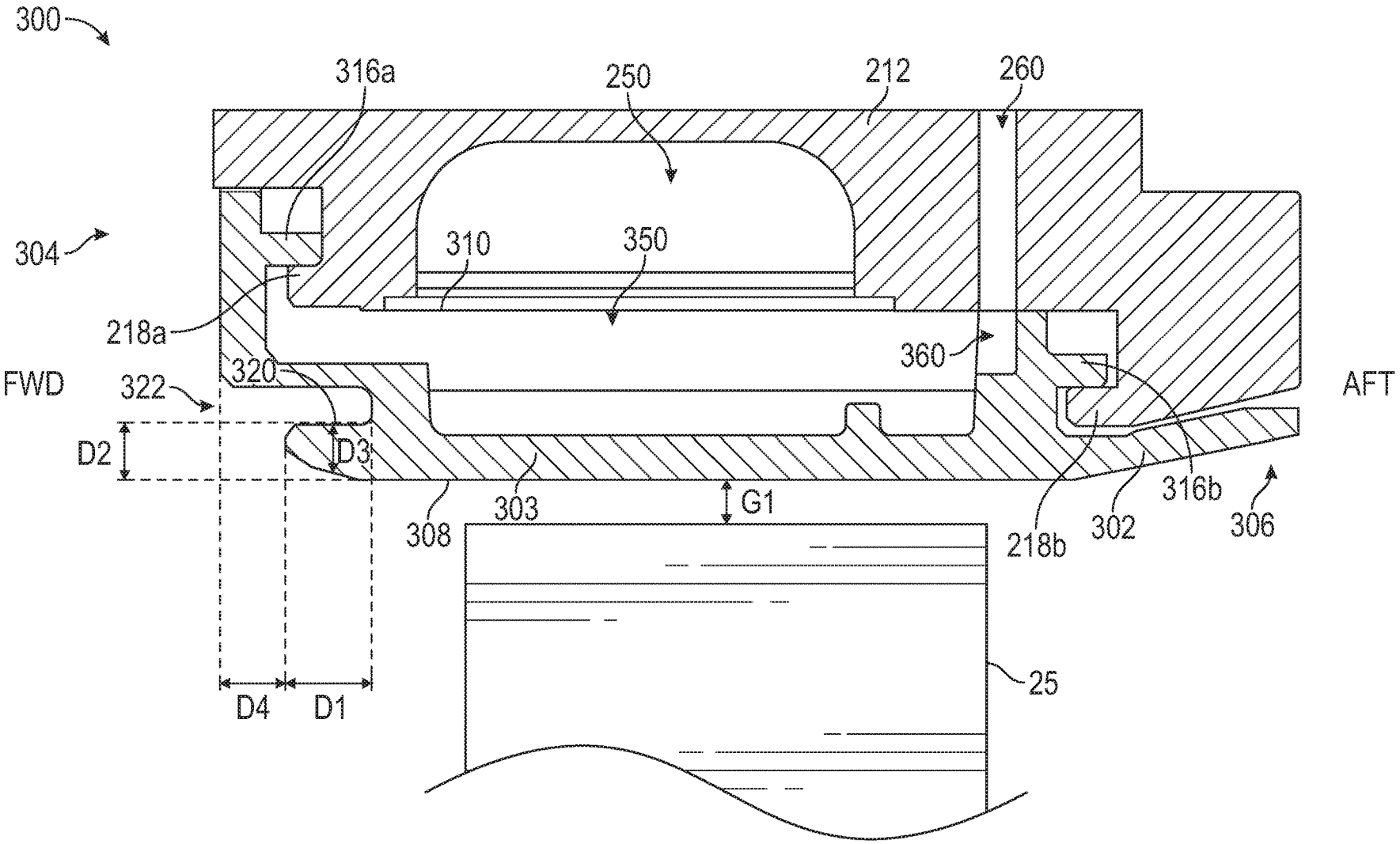
FIG. 3 is a schematic cross-sectional illustration of a blade tip clearance system for use in a gas turbine engine, in accordance with an embodiment of the disclosure.

Turning now to FIG. 3, a non-limiting example embodiment of a blade-tip clearance system 300 is illustrated. The blade-tip clearance system 300 includes the BOAS 302. In an embodiment, the BOAS 302 is formed as a single piece comprising a unitary structure. The BOAS 302 includes: a seal body 303 having a forward side 304, an aft side 306 opposite the forward side 304, a radially inward side 308, and a radially outward side 310 opposite the radially inward side 308. The BOAS 303 may shaped to form a complete ring or may be broken into a plurality of spate arc segments that form a complete ring when assembly. The BOAS 302 also includes a relief gap 322 within the seal body 303 to allow a portion (i.e. peninsula portion 320) of the radially inward side 308 to expand into the relief gap 322 when the seal body 303 is heated. As mentioned above, the BOAS 302 is located aft of the combustor 56 and is exposed to high temperatures from the combustor 56. Advantageously, allowing a portion of the radially inward side 308 to expand into the relief gap 322 when the seal body 303 is heated relieves stress on the entire seal body 303, thus helping to maintain the clearance gap G1 between the radially inward side 308, and the blade 25. In an embodiment, the relief gap 322 is located on the forward side 304 of the seal body 303. In another embodiment, the relief gap 322 initiates on the forward side 304 of the seal body 303 and extends into the seal body 303 a first distance D1. In another embodiment, relief gap 322 is located at a second distance D1 away from the radially inward side 308. The relief gap 322 may be located such that it forms a peninsula portion 320 interposed between the relief gap 322 and the radially inward side 308, as seen in FIG. 3. As also seen in FIG. 3, thickness D3 of the peninsula portion 322 may decrease towards the forward side 304. The radially inward side 308 at the peninsula portion 320 may also curve up towards the relief gap 322, as seen in FIG. 3. The forward side 304 of the peninsula portion 320 may be offset towards the aft side 306 from a remaining portion of the forward side 304, as seen by D4 in FIG. 3.

The blade-tip clearance system 300 also includes the engine case 212. The BOAS 302 is fixedly connected to the engine case 212. The BOAS 302 may be fixedly connected to the engine case 212 through at least one hook 218 on the engine case 212 interlocked with at least one hook 316 on the BOAS 302. As seen in FIG. 3, the BOAS 302 may also be fixedly connected to the engine case 212 through a forward hook 218*a* on the engine case interlocked with a forward hook 316*a* on the forward side 304 of the BOAS 302 and an aft hook 218*b* on the engine case 212 interlocked with an aft hook 316*b* on the aft side 306 of the BOAS 302.

The BOAS 302 may also include a cooling fluid compartment 350 within the seal body 303, as seen in FIG. 3. The cooling fluid compartment 350 is fluidly connected to a cooling fluid compartment 250 within the engine case 212. Each cooling fluid compartment 350, 250 may be filled with a cooling fluid (i.e. heat absorptive fluid) to help remove heat. The cooling fluid enters through a first pipeline 260 in the engine case 212 and then is transferred to the cooling fluid compartments 350, 250 through a second pipeline 360 in the seal body 303.

Figure 4:
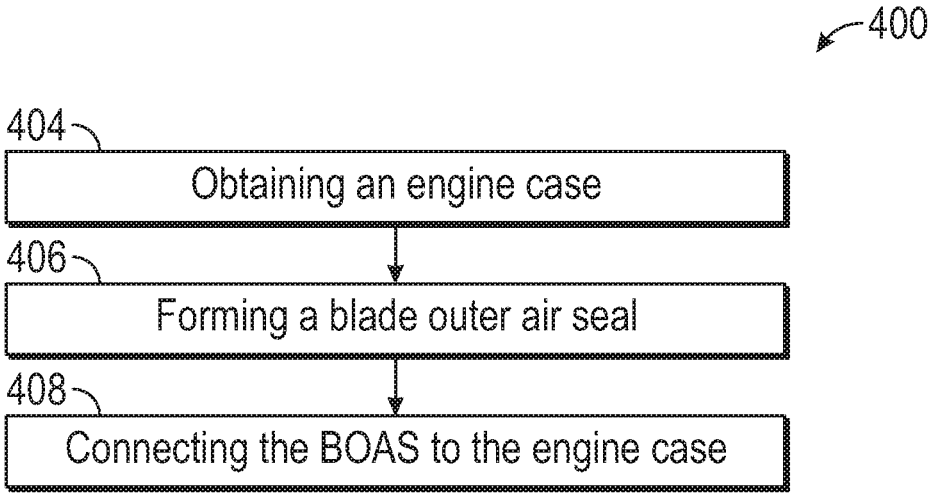
FIG. 4 is a flow process illustrating a method of the blade tip clearance system, in accordance with an embodiment of the disclosure.

Referring now to FIG. 4, while referencing components of FIGS. 1-3. FIG. 4 shows a flow chart illustrating a method 400 for assembling a blade-tip clearance system 300 for a gas turbine engine 20, in accordance with an embodiment. At block 404, a BOAS is formed. As described above, the BOAS 302 includes: a seal body 303 having a forward side 304, an aft side 306 opposite the forward side 304, a radially inward side 308, and a radially outward side 310 opposite the radially inward side 308; and a relief gap 322 within the seal body 303 to allow a portion of the radially inward side 308 to expand into the relief gap 322 when the seal body 303 is heated. At block 406, an engine case 212 is obtained. At block 406, the BOAS 302 is fixedly connected to the engine cases 212. As mentioned above, the BOAS 302 may be fixedly connected to the engine case 212 through at least one hook 218 on the engine case 212 interlocked with at least one hook 316 on the BOAS 302. The at least one hook on the BOAS 302 is located on the radially outward side 310 of the BOAS 302. As also mentioned above, the BOAS 302 may be fixedly connected to the engine case 212 through a forward hook 218*a* on the engine case interlocked with a forward hook 316*a* on the forward side 304 of the BOAS 302 and an aft hook 218*b* on the engine case 212 interlocked with an aft hook 316*b* on the aft side 306 of the BOAS 302.

While the above description has described the flow process of FIG. 4 in a particular order, it should be appreciated that unless otherwise specifically required in the attached claims that the ordering of the steps may be varied.

Technical effects of embodiments of the present disclosure include utilizing a gap within a BOAS to allow for thermal expansion of the BOAS, thus reducing stress within the BOAS and maintaining gap clearance between the BOAS and the blade.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A blade outer air seal comprising:

a seal body having a forward side, an aft side opposite the forward side, a radially inward side, and a radially outward side opposite the radially inward side;

a relief gap within the seal body to allow a portion of the radially inward side to expand into the relief gap when the seal body is heated, wherein the blade outer air seal is formed as a single piece comprising a unitary structure, wherein the relief gap is located on the forward side of the seal body, and wherein the relief gap initiates on the forward side of the seal body and extends into the seal body a first distance, and a peninsula portion interposed between the relief gap and the radially inward side, wherein a thickness of the peninsula portion decreases towards the forward side, and wherein the forward side is composed of a forward side of the peninsula portion and a remaining portion of the forward side, the forward side of the peninsula portion and the remaining portion of the forward side being separated by the relief gap, and wherein the forward side of the peninsula portion is offset towards the aft side from the remaining portion of the forward side.

2. The blade outer air seal of claim 1, wherein the relief gap is located at a second distance away from the radially inward side.

3. The blade outer air seal of claim 1, wherein the radially inward side at the peninsula portion curves towards the relief gap.

4. A blade-tip clearance system for a gas turbine engine, the blade tip clearance system comprising:

an engine case;

a blade outer air seal connected to the engine case, the blade outer air seal including:

a seal body having a forward side, an aft side opposite the forward side, a radially inward side, and a radially outward side opposite the radially inward side; and a relief gap within the seal body to allow a portion of the radially inward side to expand into the relief gap when the seal body is heated, wherein the blade outer air seal is formed as a single piece comprising a unitary structure, wherein the relief gap is located on the forward side of the seal body, and wherein the relief gap initiates on the forward side of the seal body and extends onto the seal body a first distance, and a peninsula portion interposed between the relief gap and the radially inward side, wherein a thickness of the peninsula portion decreases towards the forward side, and wherein the forward side is composed of a forward side of the peninsula portion and a remaining portion of the forward side, the forward side of the peninsula portion and the remaining portion of the forward side being separated by the relief gap, and wherein the forward side of the peninsula portion is offset towards the aft side from the remaining portion of the forward side.

5. The blade-tip clearance system of claim 4, wherein the relief gap is located at a second distance away from the radially inward side.

6. The blade-tip clearance system of claim 4, wherein the radially inward side at the peninsula portion curves towards the relief gap.

7. The blade-tip clearance system of claim 4, wherein the blade outer air seal is connected to the engine case through at least one hook on the engine case interlocked with at least one hook on the blade outer air seal.

8. The blade-tip clearance system of claim 4, wherein the blade outer air seal is connected to the engine case through a forward hook on the engine case interlocked with a forward hook on the forward side of the blade outer air seal and an aft hook on the engine case interlocked with an aft hook on the aft side of the blade outer air seal.

9. The blade-tip clearance system of claim 4, wherein the blade outer air seal further comprises a cooling fluid compartment within the seal body, the cooling fluid compartment being fluidly connected to a cooling fluid compartment within the engine case.

10. A method of assembling a blade-tip clearance system for a gas turbine engine, the method comprising:

forming a blade outer air seal, wherein the blade outer air seal is formed as a single piece comprising a unitary structure, the blade outer air seal comprising:

a seal body comprising:

a forward side;

an aft side opposite the forward side;

a radially inward side, a radially outward side opposite the radially inward side;

one or more hooks on the radially outward side of the blade outer air seal;

a relief gap within the seal body to allow a portion of the radially inward side to expand into the relief gap when the seal body is heated, wherein the relief gap is located on the forward side of the seal body, wherein the relief gap initiates on the forward side of the seal body and extends into the seal body a first distance; and a peninsula portion interposed between the relief gap and the radially inward side, wherein a thickness of the peninsula portion decreases towards the forward sided, and wherein the forward side is composed of a forward side of the peninsula portion and a remaining portion of the forward side, the forward side of the peninsula portion and the remaining portion of the forward side being separated by the relief gap, and wherein the forward side of the peninsula portion is offset towards the aft side from the remaining portion of the forward side;

obtaining an engine case including one or more hooks on the engine case; and connecting the blade outer air seal to the engine case by interlocking the one or more hooks on the radially outward side of the blade outer air seal with the one or more hooks on the engine case.

* * * * *